United States Patent [19]

Harris

[11] 4,281,840

[45] Aug. 4, 1981

[54] HIGH TEMPERATURE PACKER ELEMENT FOR WELL BORES

[75] Inventor: Allen E. Harris, Duncan, Okla.

[73] Assignee: Halliburton Company, Duncan, Okla.

[21] Appl. No.: 144,791

[22] Filed: Apr. 28, 1980

[51] Int. Cl.[3] ..... E21B 33/129

[52] U.S. Cl. ..... 277/117; 277/124

[58] Field of Search ..... 277/116, 115, 116.2, 277/116.4, 116.6, 116.8, 117, 120, 124

[56] References Cited

U.S. PATENT DOCUMENTS

| | | |
|---|---|---|
| 3,131,764 | 5/1964 | Muse et al. . |
| 3,181,614 | 5/1965 | Brown . |
| 3,288,222 | 11/1966 | Urbanosky . |
| 3,330,357 | 7/1967 | Elliston . |
| 3,371,716 | 3/1968 | Current . |
| 3,554,280 | 1/1971 | Tucker . |
| 3,559,733 | 2/1971 | Kilgore . |
| 3,666,010 | 5/1972 | Harris . |
| 4,151,875 | 5/1979 | Sullaway . |
| 4,176,715 | 12/1979 | Bigelow et al. . |

*Primary Examiner*—Robert I. Smith

*Attorney, Agent, or Firm*—Joseph A. Walkowski; John H. Tregoning

[57] ABSTRACT

This invention relates to packer element design for use in high temperature well bores. Packing material of asbestos fibers impregnated with a thermoplastic and interwoven with Inconel wire is employed in a center packer ring of triangular cross-section disposed between two facing series of frusto-conically shaped packer rings, which are backed by expandable metal packer shoes.

20 Claims, 2 Drawing Figures

HIGH TEMPERATURE PACKER ELEMENT FOR WELL BORES

BACKGROUND OF THE INVENTION

The invention relates to high temperature packer element arrangements for use in well bores, particularly those of the geothermal variety. Presently, high temperature packers and bridge plugs have been used with some degree of success at temperatures up to approximately 500° F. Above this temperature, prior art packers will not hold high differential pressures for long time intervals. Packers employing back-up elements made of intermediate hard thermoplastics such as polytetrafluoroethylene (Teflon) to sealing elements made of other fluorocarbon elastomers such as Fluorel and Viton have been used in steam injection packers up to approximately 550° F. These packers, however, are set at relatively low temperatures before being exposed to the operating temperature. Running such a packer in an operating temperature (approximately 550° F.) results in failure to hold pressure due to unacceptable behavior of the thermoplastic when subjected to compressive load to initiate the desired seal. Packing made of woven asbestos and Inconel wire has also been used for packing elements at temperatures above 500° F., such elements normally being backed with expandable metal packer shoes. However, when subjected to high differential pressures, leakage occurs to an extent tolerable in steam injection wells but excessive for many geothermal applications.

SUMMARY OF THE INVENTION

In contrast to the prior art, the present invention comprises a packer element design capable of maintaining high differential pressures for extended time intervals at temperatures as high as 700° F. Frusto-conical shaped packer rings of asbestos fiber, impregnated with an intermediate hard thermoplastic such as polytetrafluoroethylene (Teflon) and interwoven with Inconel wire, surround a mandrel on each longitudinal side of a center packer ring of triangular cross-section. The frusto-conical rings are backed at their furthest longitudinal extent by expandable metal packer shoes. The frusto-conical rings are compressed against the center ring when the pack-off device is set in the well bore, the Inconel and asbestos providing mechanical strength and resiliency at high temperatures, with the thermoplastic bridging between the asbestos and wire fibers to prevent steam or fluid migration through the packer element. The metal packer shoes lend structural support to the packer element compressed between them.

DESCRIPTION OF THE PREFERRED EMBODIMENT

Figure 1:
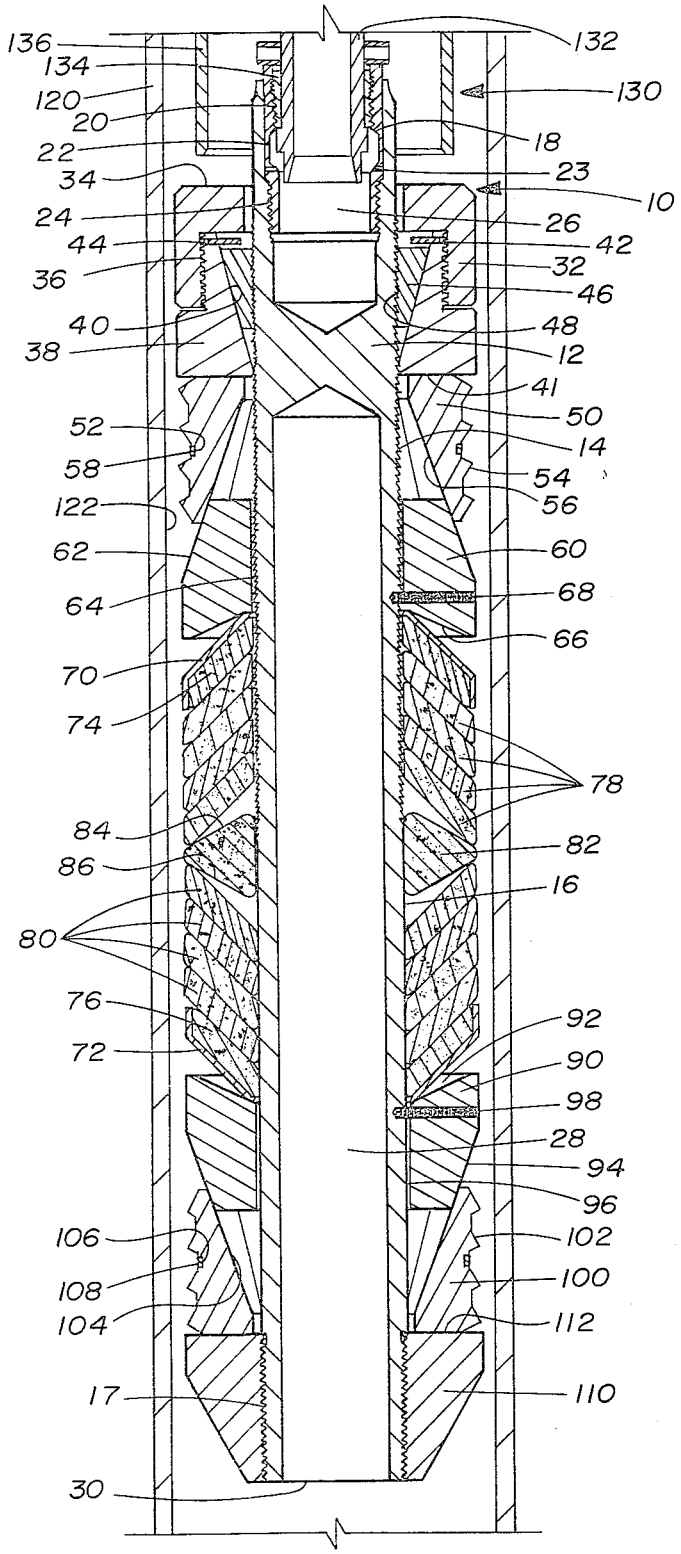
FIG. 1 is a vertical cross-sectional elevation of a bridge plug employing the packer element design of the present invention, as it is being run in the well bore casing on a setting tool.

Bridge plug 10 includes mandrel 12, which possesses circumferential downward facing teeth 14 along most of its upper exterior. Lower exterior 16 of mandrel 12 is smooth to lower end 17, which is threaded. Tension sleeve 18 is installed in the upper bore 26 of mandrel 12. Tension sleeve 18 comprises an annular member having an upper internal threaded portion at 20 and a lower external threaded portion at 24, at which point it is fixed to mandrel 12. There is a portion of reduced wall thickness 22 substantially at the midpoint of the tension sleeve 18. A plurality of holes 23 allow fluid communication between the interior and exterior of tension sleeve 18.

Lower bore 28 of mandrel 12 is open at its lower end 30.

Disposed about the upper exterior of mandrel 12 is the upper slip and wedge assembly, which includes overshot slip sleeve 32 having flat upper annular surface 34, and which is threaded at 36 to retainer sleeve 38 having frusto-conical inner surface 40 and flat annular surface 41 at its lower end. Within the space defined by frusto-conical inner surface 40, is disposed a split ring 46 of wedge-shaped cross-section. The exterior surface of ring 46 is oriented at substantially the same angle as that of frusto-conical inner surface 40 of retainer sleeve 38, while the interior surface of ring 46 possesses circumferential upward-facing teeth 48 of substantially identical spacing as that of downward-facing teeth 14 on mandrel 12. Pins 42 and 44 extend through retainer sleeve 38 and restrict axial movement of split ring 46.

Below retainer sleeve 38, slips 50, comprising arcuate shaped members, surround mandrel 12. Slips 50 have serrated cylindrical exterior surfaces 54 containing circumferential channels 52. The interior surfaces 56 and slips 50 define a generally conical shape. A cylindrical metal band 58 encircles slips 50 in channels 52 to retain them in retracted position prior to setting of the bridge plug. The lower ends of slips 50 rest on the upper radial surface 62 of upper wedge ring 60, which is oriented at substantially the same angle as interior surfaces 56 of slips 50. Bore 64 of upper wedge ring 60 is smooth and of a greater diameter than that of teeth 14 on mandrel 12. Lower surface 66 of upper wedge ring 60 extends radially outward and downward at a shallow radial angle. Upper wedge ring 60 is retained on mandrel 12 by a plurality of machine screws 68 which are threaded through wedge ring 60 and into mandrel 12.

Abutting the lower surface 66 of upper wedge ring 60 is downward-facing packer shoe 70. Packer segments are disposed about packer mandrel 12 between downward facing packer shoe 70 and upward-facing packer shoe 72. The packer segments are made of asbestos fiber impregnated with an intermediate hard thermoplastic such as Teflon, interwoven with Inconel wire. The resulting fabric is laid up in a preform, and subsequently pressure molded to form the desired segment shape. End packer rings 74 and 76, of frusto-conical cross-section with substantially parallel radially inclined side faces are overshot by the ends of packer shoes 70 and 72, respectively. Between end packer ring 74 and center packer ring 82, which is of substantially triangular cross-section with side faces 84 and 86 convergently radially inclined at substantially equal angles, are a plurality of substantially identical downward-facing frusto-conical packer rings 78, the outer diameter of which approximates that of packer shoe 70 prior to packer element compression. Similarly, a plurality of substantially identical upward-facing frusto-conical packer rings 80 are located between center packer ring 82 and end packer ring 76. Rings 80, like rings 78, are of substantially the same outer diameter in their uncompressed state as packer shoes 70 and 72 and, like end packer rings 74 and 76, have substantially parallel radially inclined side faces. The angle of radial inclination of the side faces of packer rings 74, 76, 78 and 80 is greater than that of side faces 84 and 86 of center packer ring 82. The packer element thus comprises packer segments 74, 76, 78, 80 and 82.

Below, and backing packer shoe 72 is lower wedge ring 90, having upper conical surface 92 inclined at a shallow radial angle. Inner surface 96 of lower wedge ring 90 is smooth, and of greater diameter than that of mandrel 12 at area 16. Lower radial surface 94 of lower wedge ring 90 is oriented at an angle to the vertical. Machine screws 98, one of which is shown, are threaded through lower wedge ring 90 and into mandrel 12, which screws maintain lower wedge ring 90 in position until bridge plug 10 is set.

Between lower wedge ring 90 and end ring 110, which is threaded to packer mandrel 12 at lower end 17, are slips 100, comprising arcuate shaped members which surround mandrel 12. Slips 100 have serrated cylindrical exterior surfaces 102, while interior surfaces 104 are oriented at substantially the same angle as lower radial surface 94 of lower wedge ring 90, and ride thereupon. Circumferential channel 106 traverses the exterior of each of slips 100, metal band 108 in channel 106 maintaining slips 100 in place until bridge plug 10 is set. Slips 100 also ride upon flat upper surface 112 of end ring 110.

The parts of the tool other than the packer element should, of course, be formed of materials capable of withstanding high (700° F.) temperatures without losing mechanical strength. This is particularly important in choosing a material for elements such as the packer shoes and tension sleeve, as some materials, such as brass, would not give the desired performance. For example, a brass tension sleeve would not permit sufficient setting tension to be placed on the mandrel at normal operating temperatures, as it would shear at an excessively low applied force. Choice of appropriate metals for the setting and compressing structures is, of course, within the ability of one of ordinary skill in the art. Mild steel, appropriately annealed, may be used as a substitute for the brass components normally employed in a lower temperature pack-off device.

Figure 2:
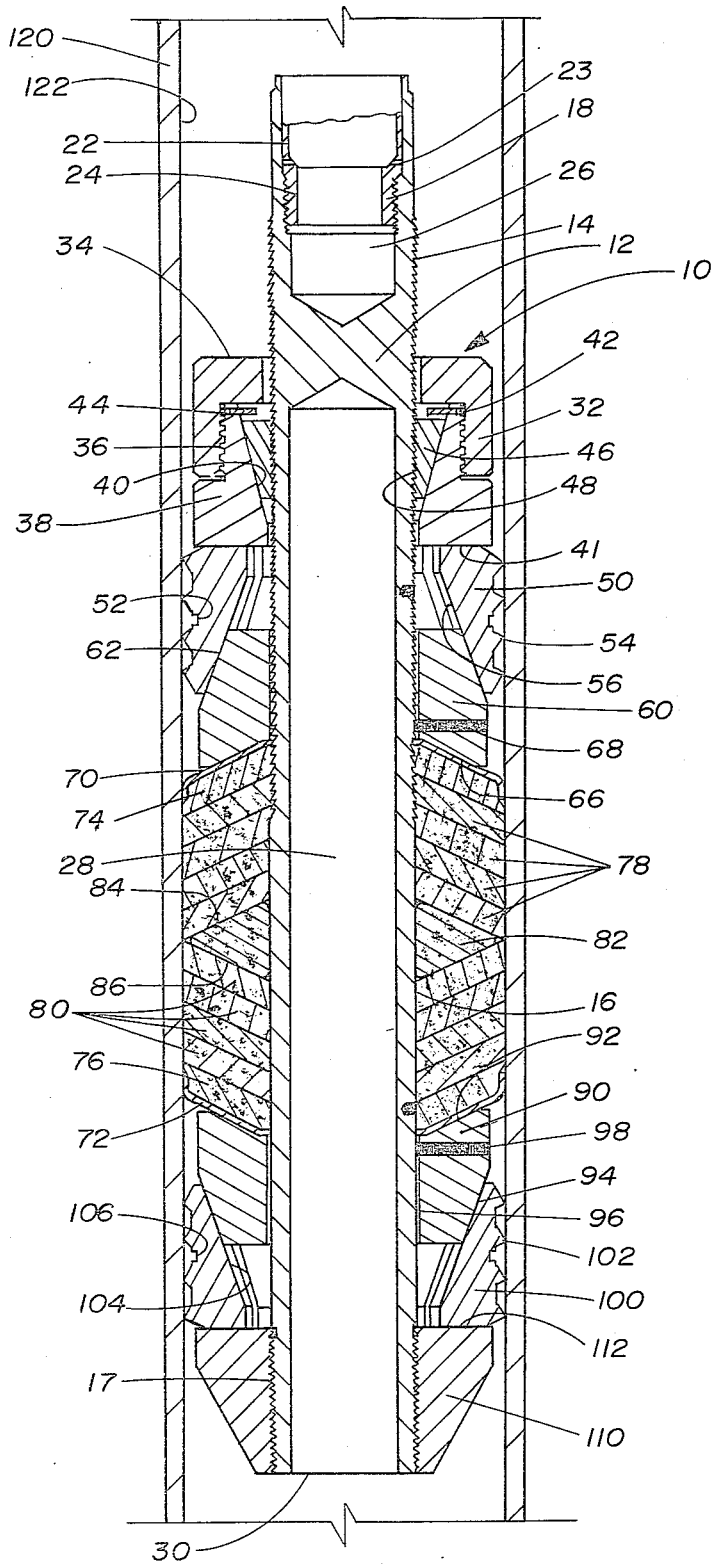
FIG. 2 is a vertical cross-sectional elevation of the bridge plug of FIG. 1 after it has been set in the well bore casing.

Referring both to FIGS. 1 and 2, the operation of the present invention will be described hereafter. Bridge plug 10 is hung in well bore casing 120 from setting tool 130, which may be one of many types in the art, activated on wireline, tubing, or drill pipe, the operative mechanism of the tool not being germane to the present invention. Setting tool 130 should comprise a setting mandrel 132 having a threaded end, such as coupling ring 134 shown, the mandrel 132 being surrounded by setting sleeve 136.

To set the bridge plug 10, setting sleeve 136 is moved downward relative to setting mandrel 132. Setting sleeve 136 will contact flat annular surface 34 of overshot slip sleeve 32, pushing it, retainer sleeve 38 and split ring 46 downward, thus forcing slips 50 downward and outward against upper radial surface 62 of upper wedge ring 60. Split ring 46 is permitted downward motion as the teeth 48 on its inner surface are, as previously noted, facing upward, and the downward movement of retainer sleeve 38 will provide clearance for such movement. The outward movement of slips 50 will break metal band 58, permitting slips 50 to contact the inner wall 122 of casing 120 as serrated surfaces 54, which will grip the casing wall 122. The setting of upper slips 50 restricts any further downward movement of setting sleeve 136. Slips 50 are prevented from returning to their retracted position by the engagement of teeth 48 of split ring 46 with teeth 14 on mandrel 12. Split ring 46 is held against mandrel 12 by the wedging action of retainer sleeve 38.

Upper slips 50 having been set, setting mandrel 132 is pulled upward, the upward force being transmitted to mandrel 12 through coupling ring 134 and tension sleeve 18, to which coupling ring 134 is threaded at 20. Upward movement of mandrel 12 immediately shears machine screws 68 in upper wedge ring 60, which is constrained against the movement of the mandrel 12. Movement of mandrel 12, transmitted by end ring 110, forces slips 100 and lower wedge ring 90 upwardly against lower packer shoe 72, packer segment 74 being compressed by segments 76, 78, 80 and 82 against upper packer shoe 70, which expands against the lower face of upper wedge ring 66, and contacts casing wall 122. Further upward movement causes increased compression of all packer segments, increasing their effective diameter, and causing contact with casing wall 122, after which machine screws 98 in lower wedge ring 90 shear, allowing lower wedge ring 90 to move relatively downward against the angled interior surface of slips 100, which are forced both downward and outward, breaking metal band 108 which encircles them. Slips 100 then contact casing wall 122, and, as mandrel 12 continues its upward movement, packer segments 74, 76, 78, 80 and 82 are further compressed, lower packer shoe 72 is expanded outwardly to contact casing wall 122, and is backed up by upper surface 92 of lower wedge ring 90. When compression of the packer segments reaches a predetermined point, and lower slips 100 are forced against casing wall 122 to the extent that no further upward motion is possible, the axial force from mandrel 132 of setting tool 130 will exceed the shear strength of reduced wall thickness portion 22 of tension sleeve 18, parting it as shown in FIG. 2. At this point, bridge plug 10 is set (FIG. 2), upward force (such as by differential pressure) being resisted by slips 100, downward force being resisted by slips 60, and a seal being effected by the compression of packer elements between mandrel 12, casing wall 122, and packer shoes 70 and 72.

It should be apparent that a number of different design features interact to form a more effective seal when the bridge plug is set. The thermoplastic impregnation of the asbestos fiber will bridge between that material and the interwoven Inconel wire to prevent steam or fluid migration through the packer element to a much greater degree than was heretofore possible. The Inconel wire/asbestos fiber weave provides a resiliency to the packer element which is less affected by temperature extremes than ordinary elastomeric elements, thus better maintaining the "spring" or setting-induced compression of the packer element which makes the bridge plug seal more effective against directional changes in pressure and pressure cycling. Triangular center packer ring 82 causes outward rotational movement of packer rings 74, 76, 78 and 80 as sides 84 and 86 of center packer ring 82 are oriented at a lesser angle than are the frusto-conical packer rings when setting loads are applied, enhancing the seal against casing wall 122 and providing a torsional as well as a longitudinal compressional counterforce to maintain the bridge plug in a set position. Furthermore, the center packer ring 82 provides a positive seal against the mandrel on its inner surface, which is loaded radially inwardly by the frusto-conical packer ring sets on either side. The stacking of the frusto-conical packer rings in an opposing symmetrical manner with respect to the center packer ring results in an effective seal against differential pressure in either direction, as the outer edges of the downward-facing frusto-conical packer rings will be forced into tighter sealing engagement in response to greater differential pressure below the bridge plug, while greater downward-acting differential pressure will more tightly seal the upward-facing rings. The sealing effect in both of these instances is due to the action of the pressure upon the center packer ring, which radially spreads the set of the rings facing the direction of the applied pressure. The metal packer shoes at each end of the packer element lend structural support to the packer element by bridging the gap between the wedge-rings and casing or borehole wall. It is thus readily apparent that the packer element design of the present invention possesses many advantages over the prior art. An effective seal may be created and maintained for long time intervals against high differential pressures at temperature extremes up to approximately 700° F. In addition, the seal is maintained against differential pressures in either direction, the tendency to seal being augmented in both directions by application of pressure.

While a bridge plug has been disclosed herein suspended and set in casing, it must be noted that the packer element design is equally suitable for use in a packer or any sort of pack-off device, and that the packer element design is effective in open borehole as well as casing. Furthermore, the packer element design may be used in packer and bridge plug assemblies other than that disclosed, the assembly being shown herein by way of illustration and not by way of limitaton. Any packer or bridge plug which employs compressive longitudinal force against the packer elements may be employed.

Certain modifications to the disclosed embodiment are possible without departing from the scope of the invention. For example, a packer element comprising a center packer ring of triangular cross-section with the base of the triangle on the exterior of the element rather than against the mandrel may be employed, with frusto-conical packer rings facing away from the center ring. The base of the triangle would then seal against the casing or borehole wall, the torsionally and compressionally loaded frusto-conical rings being expanded both against the mandrel and the casing or borehole wall. Furthermore, if a wider base seal is desired, a center packer ring of trapezoidal cross-section may be employed in either disclosed ring arrangement, the limitation being the amount of tool length the trapezoidal cross-section would add.

While the foregoing is a description of the packer element design of certain embodiments, those skilled in the art and familiar with the disclosure of the invention may recognize certain additions, deletions, substitutions or other modifications which would fall within the purview of the invention as defined by the claims.

What is claimed is:

1. In a pack-off device of the type having a mandrel and means to longitudinally compress a packer element disposed about said mandrel, a packer element comprising:

a center packer ring having two oblique side faces;

a first plurality of frusto-conical packer rings having substantially parallel oblique side faces and arranged adjacent said center packer ring;

a second plurality of frusto-conical packer rings having substantially parallel oblique side faces and arranged adjacent said center packer ring;

said oblique side faces of said first and second plurality of frusto-conical packer rings having an angle of radial inclination greater than the angle of radial inclination of said center packer ring side faces.

2. The packer element of claim 1, wherein said first plurality of frusto-conical packer rings faces said second plurality of frusto-conical packer rings and said oblique side faces of said center packer ring are convergent in a radially outward direction.

3. The packer element of claim 2, wherein said oblique side faces are inclined at substantially the same radial angle.

4. The packer element of claim 3, wherein the packer ring on the end of each plurality of frusto-conical packer rings away from said center packer rings is of reduced outer diameter.

5. The packer element of claim 4, wherein each of said end packer rings is overshot by an outer extremity of a packer shoe disposed adjacent thereto.

6. The packer element of claim 5, wherein all of said packer rings comprise asbestos impregnated with a thermoplastic and interwoven with Inconel wire.

7. The packer element of claim 6, wherein said thermoplastic is an intermediate hard thermoplastic.

8. The packer element of claim 7, wherein said intermediate hard thermoplastic is polytetrafluoroethylene.

9. The packer element of claim 1, wherein said first plurality of frusto-conical packer rings faces away from said second plurality of frusto-conical packer rings and said oblique side faces of said center packer ring are divergent in a radially outward direction.

10. The packer element of claim 9, wherein said oblique side faces are inclined at substantially the same radial angle.

11. The packer element of claim 10, wherein all of said packer rings comprise asbestos impregnated with a thermoplastic and interwoven with Inconel wire.

12. The packer element of claim 11, wherein said thermoplastic is an intermediate hard thermoplastic 13. The packer element of claim 12, wherein said intermediate hard thermoplastic is polytetrafluoroethylene.

14. A packer element for use on a mandrel of a pack-off device of the type which effects a seal across a well bore through longitudinal compression of said element, comprising:

a center packer ring having two oblique non-parallel side faces;

a first plurality of frusto-conical packer rings possessing oblique, substantially parallel side faces and abutting said center packer ring;

a second plurality of frusto-conical packer rings possessing oblique, substantially parallel side faces and abutting said packer ring;

said side faces of said first and second pluralities of frusto-conical packer rings being inclined at a greater radial angle than said non-parallel side faces of said center packer ring.

15. The packer element of claim 14, wherein all of said first plurality of frusto-conical packer rings are oriented to face in one direction, and all of said second plurality of frusto-conical rings are oriented to face in the opposite direction.

16. The packer element of claim 15, wherein said oblique side faces of said center packer ring are radially outwardly convergent and said frusto-conical packer rings of said first plurality face away from those of said second plurality.

17. The packer element of claim 15, wherein said oblique side faces of said center packer ring are radially outwardly divergent and said frusto-conical packer rings of said first plurality face away from those of said second plurality.

18. The packer element of claim 16 or 17, wherein all of said packer rings comprise asbestos impregnated with a thermoplastic and interwoven with Inconel wire.

19. The packer element of claim 18, wherein said thermoplastic is an intermediate hard thermoplastic.

20. The packer element of claim 19, wherein said intermediate hard thermoplastic is polytetrafluoroethylene.

* * * * *

UNITED STATES PATENT AND TRADEMARK OFFICE

CERTIFICATE OF CORRECTION

PATENT NO. : 4,281,840

DATED : August 4, 1981

INVENTOR(S) : Allen E. Harris

It is certified that error appears in the above-identified patent and that said Letters Patent are hereby corrected as shown below:

In column 3, line 49, following the word "types" insert --known--.

Signed and Sealed this

*Eighth* Day of *December 1981*

[SEAL]

*Attest:*

GERALD J. MOSSINGHOFF

*Attesting Officer*

*Commissioner of Patents and Trademarks*